US010950070B2

(12) United States Patent
Sun et al.

(10) Patent No.: US 10,950,070 B2
(45) Date of Patent: Mar. 16, 2021

(54) MALFUNCTION DETECTION OF SHARED VEHICLES

(71) Applicant: INTERNATIONAL BUSINESS MACHINES CORPORATION, Armonk, NY (US)

(72) Inventors: Changhua Sun, Beijing (CN); Shiwan Zhao, Beijing (CN); Li Zhang, Beijing (CN); HongLei Guo, Beijing (CN); Zhong Su, Beijing (CN)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 175 days.

(21) Appl. No.: 16/130,120

(22) Filed: Sep. 13, 2018

(65) Prior Publication Data

US 2020/0090427 A1 Mar. 19, 2020

(51) Int. Cl.

| | |
|---|---|
| ***G07C 5/08*** | (2006.01) |
| ***G08G 1/01*** | (2006.01) |
| ***G08G 1/00*** | (2006.01) |
| ***G07C 5/00*** | (2006.01) |

(52) U.S. Cl.

CPC ..... *G07C 5/0808* (2013.01); *G07C 5/008* (2013.01); *G08G 1/0112* (2013.01); *G08G 1/20* (2013.01)

(58) Field of Classification Search

CPC .... G07C 5/0808; G07C 5/008; G07C 5/0816; G08G 1/20; G08G 1/0112

See application file for complete search history.

(56) References Cited

U.S. PATENT DOCUMENTS

2016/0086391 A1* 3/2016 Ricci ..... G07C 5/008 701/29.3

FOREIGN PATENT DOCUMENTS

| | | | |
|---|---|---|---|
| CN | 107134118 | A | 9/2017 |
| CN | 107170237 | A | 9/2017 |
| CN | 107392706 | A | 11/2017 |
| CN | 107833311 | A | 3/2018 |

* cited by examiner

*Primary Examiner* — Michael V Kerrigan

(74) *Attorney, Agent, or Firm* — Tutunjian & Bitetto, P.C.; Joseph Petrokaitis

(57) ABSTRACT

A method, a device and a computer program product for managing a shared vehicle are proposed. In the method, first information about a user is obtained. The first information indicates a speed of at least one shared vehicle used by the user. A target vehicle is determined from the at least one shared vehicle based on the first information. Second information about the target vehicle is determined. The second information indicates respective speeds of the target vehicle moving at a plurality of time intervals. An abnormal state of the target vehicle is detected based on the second information. The abnormal state indicates that a malfunction occurs in the target vehicle.

17 Claims, 8 Drawing Sheets

MALFUNCTION DETECTION OF SHARED VEHICLES

BACKGROUND

Technical Field

The present invention relates to managing a shared vehicle, and more specifically, to a method, device and computer program product for shared vehicle malfunction detection.

Related Art

Shared vehicles, such as bicycles, scooters, cars, or the like, are used by service providers to provide vehicle-sharing services on a variety of locations, such on campuses, subway stations, bus stations, residential areas, commercial areas, public service areas, etc. Such vehicle-sharing service is a new type of environment friendly sharing economy, which can maximize the utilization of the public transportation. However, the damage rate of the vehicles remains high. Thus, detecting malfunctions occur in the vehicles becomes a challenge.

SUMMARY

According to one embodiment of the present invention, there is provided a method of managing a shared vehicle. In the method, first information about a user is obtained. The first information indicates a speed of at least one shared vehicle used by the user. A target vehicle is determined from the at least one shared vehicle based on the first information. Second information about the target vehicle is determined. The second information indicates respective speeds of the target vehicle moving at a plurality of time intervals. An abnormal state of the target vehicle is detected based on the second information. The abnormal state indicates that a malfunction occurs in the target vehicle.

According to another embodiment of the present invention, there is provided a device for managing a shared vehicle. The device comprises a processing unit and a memory coupled to the processing unit and storing instructions thereon. The instructions, when executed by the processing unit, performing acts including: obtaining first information about a user, the first information indicating a speed of at least one shared vehicle used by the user; determining a target vehicle from the at least one shared vehicle based on the first information; determining second information about the target vehicle, the second information indicating respective speeds of the target vehicle moving at a plurality of time intervals; and detecting an abnormal state of the target vehicle based on the second information, the abnormal state indicating that a malfunction occurs in the target vehicle.

According to yet another embodiment of the present invention, there is provided a computer program product being tangibly stored on a non-transient machine-readable medium and comprising machine-executable instructions. The instructions, when executed on a device, causing the device to perform acts including: obtaining first information about a user, the first information indicating a speed of at least one shared vehicle used by the user; determining a target vehicle from the at least one shared vehicle based on the first information; determining second information about the target vehicle, the second information indicating respective speeds of the target vehicle moving at a plurality of time intervals; and detecting an abnormal state of the target vehicle based on the second information, the abnormal state indicating that a malfunction occurs in the target vehicle.

BRIEF DESCRIPTION OF THE SEVERAL VIEWS OF THE DRAWINGS

Through the more detailed description of some embodiments of the present disclosure in the accompanying drawings, the above and other objects, features and advantages of the present disclosure will become more apparent, wherein the same reference generally refers to the same components in the embodiments of the present disclosure.

Throughout the drawings, same or similar reference numerals represent the same or similar element.

DETAILED DESCRIPTION

Figure 1:
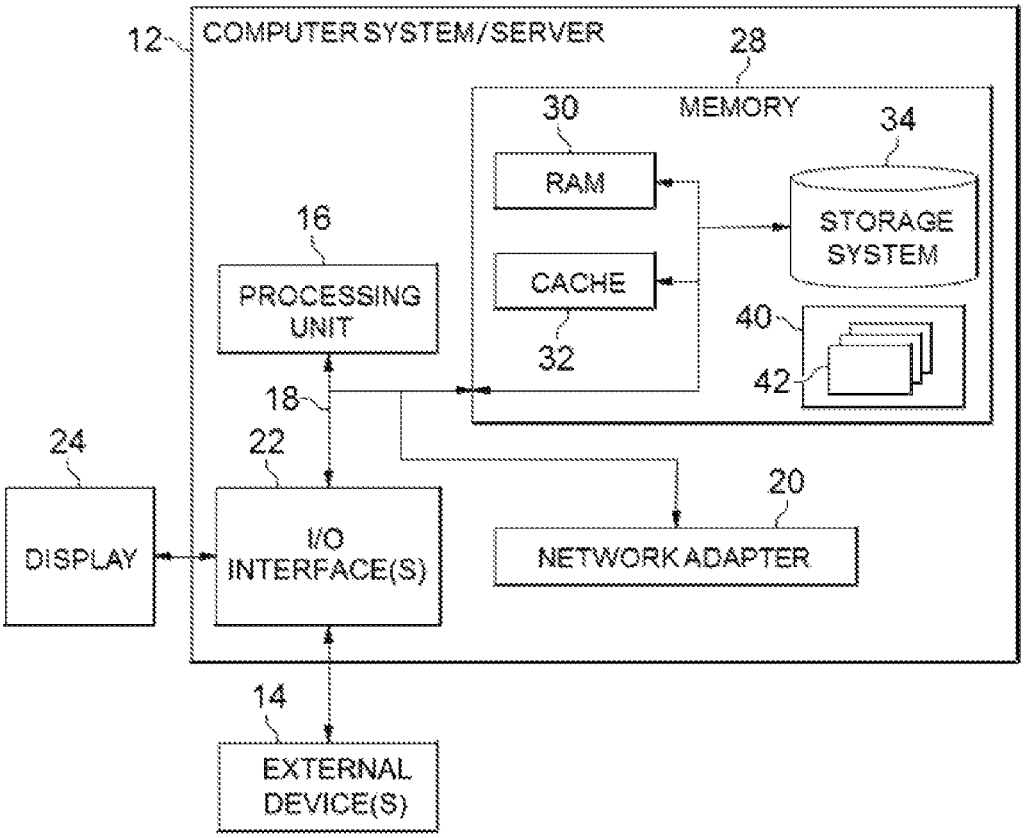
FIG. 1 depicts a cloud computing node according to an embodiment of the present invention.

Some embodiments will be described in more detail with reference to the accompanying drawings, in which the embodiments of the present disclosure have been illustrated. However, the present disclosure can be implemented in various manners, and thus should not be construed to be limited to the embodiments disclosed herein.

As used herein, the term "includes" and its variants are to be read as open ended terms that mean "includes, but is not limited to." The term "based on" is to be read as "based at least in part on." The term "one embodiment" and "an embodiment" are to be read as "at least one embodiment." The term "another embodiment" is to be read as "at least one other embodiment." Other definitions, explicit and implicit, may be included below.

It is to be understood that although this disclosure includes a detailed description on cloud computing, implementation of the teachings recited herein are not limited to a cloud computing environment. Rather, embodiments of the present invention are capable of being implemented in conjunction with any other type of computing environment now known or later developed.

Cloud computing is a model of service delivery for enabling convenient, on-demand network access to a shared pool of configurable computing resources (e.g. networks, network bandwidth, servers, processing, memory, storage, applications, virtual machines, and services) that can be rapidly provisioned and released with minimal management effort or interaction with a provider of the service. This cloud model may include at least five characteristics, at least three service models, and at least four deployment models.

Characteristics are as follows:

On-demand self-service: a cloud consumer can unilaterally provision computing capabilities, such as server time and network storage, as needed automatically without requiring human interaction with the service's provider.

Broad network access: capabilities are available over a network and accessed through standard mechanisms that promote use by heterogeneous thin or thick client platforms (e.g., mobile phones, laptops, and PDAs).

Resource pooling: the provider's computing resources are pooled to serve multiple consumers using a multi-tenant model, with different physical and virtual resources dynamically assigned and reassigned according to demand. There is a sense of location independence in that the consumer generally has no control or knowledge over the exact location of the provided resources but may be able to specify location at a higher level of abstraction (e.g., country, state, or datacenter).

Rapid elasticity: capabilities can be rapidly and elastically provisioned, in some cases automatically, to quickly scale out and rapidly released to quickly scale in. To the consumer, the capabilities available for provisioning often appear to be unlimited and can be purchased in any quantity at any time.

Measured service: cloud systems automatically control and optimize resource use by leveraging a metering capability at some level of abstraction appropriate to the type of service (e.g., storage, processing, bandwidth, and active user accounts). Resource usage can be monitored, controlled, and reported providing transparency for both the provider and consumer of the utilized service.

Service Models are as follows:

Software as a Service (SaaS): the capability provided to the consumer is to use the provider's applications running on a cloud infrastructure. The applications are accessible from various client devices through a thin client interface such as a web browser (e.g., web-based e-mail). The consumer does not manage or control the underlying cloud infrastructure including network, servers, operating systems, storage, or even individual application capabilities, with the possible exception of limited user-specific application configuration settings.

Platform as a Service (PaaS): the capability provided to the consumer is to deploy onto the cloud infrastructure consumer-created or acquired applications created using programming languages and tools supported by the provider. The consumer does not manage or control the underlying cloud infrastructure including networks, servers, operating systems, or storage, but has control over the deployed applications and possibly application hosting environment configurations.

Infrastructure as a Service (IaaS): the capability provided to the consumer is to provision processing, storage, networks, and other fundamental computing resources where the consumer is able to deploy and run arbitrary software, which can include operating systems and applications. The consumer does not manage or control the underlying cloud infrastructure but has control over operating systems, storage, deployed applications, and possibly limited control of select networking components (e.g., host firewalls).

Deployment Models are as follows:

Private cloud: the cloud infrastructure is operated solely for an organization. It may be managed by the organization or a third party and may exist on-premises or off-premises.

Community cloud: the cloud infrastructure is shared by several organizations and supports a specific community that has shared concerns (e.g., mission, security requirements, policy, and compliance considerations). It may be managed by the organizations or a third party and may exist on-premises or off-premises.

Public cloud: the cloud infrastructure is made available to the general public or a large industry group and is owned by an organization selling cloud services.

Hybrid cloud: the cloud infrastructure is a composition of two or more clouds (private, community, or public) that remain unique entities but are bound together by standardized or proprietary technology that enables data and application portability (e.g., cloud bursting for load-balancing between clouds).

A cloud computing environment is service oriented with a focus on statelessness, low coupling, modularity, and semantic interoperability. At the heart of cloud computing is an infrastructure that includes a network of interconnected nodes.

Referring now to FIG. 1, a schematic of an example of a cloud computing node is shown. Cloud computing node 10 is only one example of a suitable cloud computing node and is not intended to suggest any limitation as to the scope of use or functionality of embodiments of the invention described herein. Regardless, cloud computing node 10 is capable of being implemented and/or performing any of the functionality set forth hereinabove.

In cloud computing node 10 there is a computer system/server 12 or a portable electronic device such as a communication device, which is operational with numerous other general purpose or special purpose computing system environments or configurations. Examples of well-known computing systems, environments, and/or configurations that may be suitable for use with computer system/server 12 include, but are not limited to, personal computer systems, server computer systems, thin clients, thick clients, handheld or laptop devices, multiprocessor systems, microprocessor-based systems, set top boxes, programmable consumer electronics, network PCs, minicomputer systems, mainframe computer systems, and distributed cloud computing environments that include any of the above systems or devices, and the like.

Computer system/server 12 may be described in the general context of computer system-executable instructions, such as program modules, being executed by a computer system. Generally, program modules may include routines, programs, objects, components, logic, data structures, and so on that perform particular tasks or implement particular abstract data types. Computer system/server 12 may be practiced in distributed cloud computing environments where tasks are performed by remote processing devices that are linked through a communications network. In a distributed cloud computing environment, program modules may be located in both local and remote computer system storage media including memory storage devices.

As shown in FIG. 1, computer system/server 12 in cloud computing node 10 is shown in the form of a general-purpose computing device. The components of computer system/server 12 may include, but are not limited to, one or more processors or processing units 16, a system memory 28, and a bus 18 that couples various system components including system memory 28 to processor 16.

Bus 18 represents one or more of any of several types of bus structures, including a memory bus or memory controller, a peripheral bus, an accelerated graphics port, and a processor or local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus.

Computer system/server 12 typically includes a variety of computer system readable media. Such media may be any available media that is accessible by computer system/server 12, and it includes both volatile and non-volatile media, removable and non-removable media.

System memory 28 can include computer system readable media in the form of volatile memory, such as randomaccess memory (RAM) 30 and/or cache memory 32. Computer system/server 12 may further include other removable/non-removable, volatile/non-volatile computer system storage media. By way of example only, storage system 34 can be provided for reading from and writing to a non-removable, non-volatile magnetic media (not shown and typically called a "hard drive"). Although not shown, a magnetic disk drive for reading from and writing to a removable, non-volatile magnetic disk (e.g., a "floppy disk"), and an optical disk drive for reading from or writing to a removable, non-volatile optical disk such as a CD-ROM, DVD-ROM or other optical media can be provided. In such instances, each can be connected to bus 18 by one or more data media interfaces. As will be further depicted and described below, memory 28 may include at least one program product having a set (e.g., at least one) of program modules that are configured to carry out the functions of embodiments of the invention.

Program/utility 40, having a set (at least one) of program modules 42, may be stored in memory 28 by way of example, and not limitation, as well as an operating system, one or more application programs, other program modules, and program data. Each of the operating system, one or more application programs, other program modules, and program data or some combination thereof, may include an implementation of a networking environment. Program modules 42 generally carry out the functions and/or methodologies of embodiments of the invention as described herein.

Computer system/server 12 may also communicate with one or more external devices 14 such as a keyboard, a pointing device, a display 24, etc.; one or more devices that enable a user to interact with computer system/server 12; and/or any devices (e.g., network card, modem, etc.) that enable computer system/server 12 to communicate with one or more other computing devices. Such communication can occur via Input/Output (I/O) interfaces 22. Still yet, computer system/server 12 can communicate with one or more networks such as a local area network (LAN), a general wide area network (WAN), and/or a public network (e.g., the Internet) via network adapter 20. As depicted, network adapter 20 communicates with the other components of computer system/server 12 via bus 18. It should be understood that although not shown, other hardware and/or software components could be used in conjunction with computer system/server 12. Examples, include, but are not limited to: microcode, device drivers, redundant processing units, external disk drive arrays, RAID systems, tape drives, and data archival storage systems, etc.

Computer system/server 12 may include a dedicated portable electronic device (e.g., device 54A in FIG. 2) that can be employed to identify vehicles that are in need of repair or maintenance. Such a device may be employed to identify vehicles in accordance with the present embodiments, while a user is in the field. Using sensors, bike data (times, speeds and distances recorded by the bike or the lender/proprietor of the bike or vehicle) or global positioning systems mounted on the vehicles, the vehicles can be monitored, and once a determination is made that a vehicle is acting abnormally, the vehicles can be located and removed from service by employing the portable device 54A). In one embodiment, the device 54A can determine the abnormal state and generate an alert for a particular vehicle. Then, the vehicle can be located using global positioning or a homing signal using the portable device 54A to identify where the vehicle is while in the field.

Figure 2:
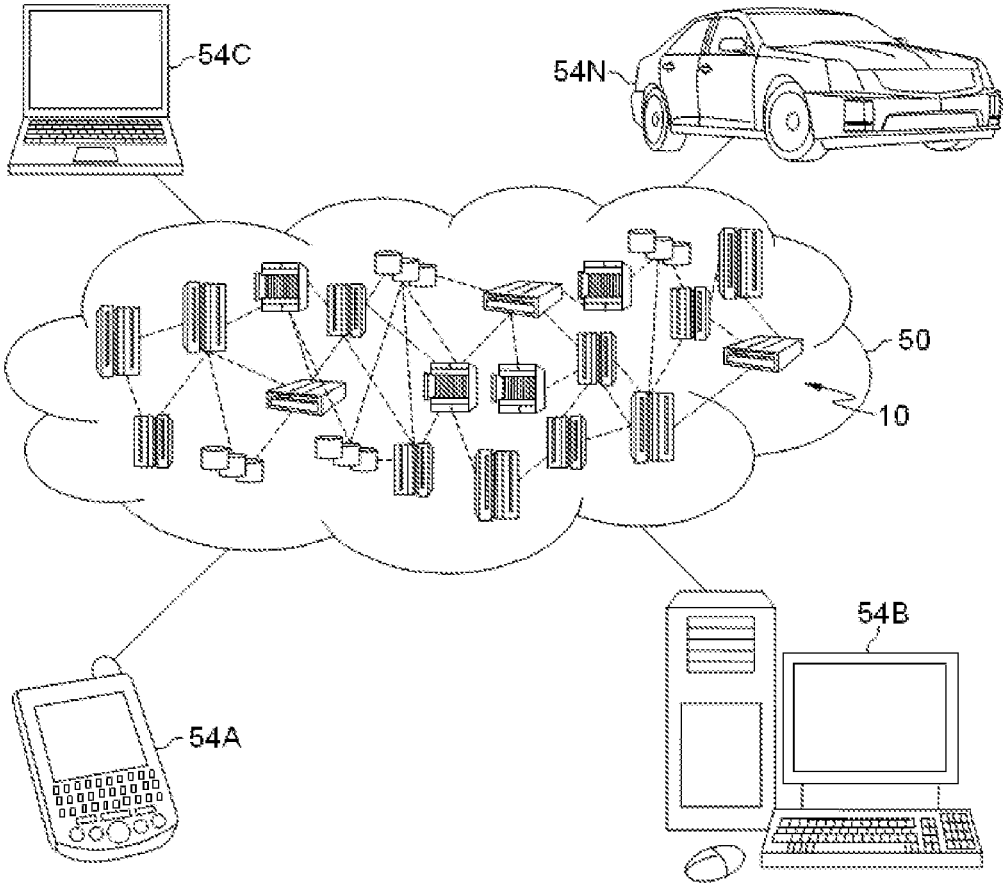
FIG. 2 depicts a cloud computing environment according to an embodiment of the present invention.

Referring now to FIG. 2, illustrative cloud computing environment 50 is depicted. As shown, cloud computing environment 50 includes one or more cloud computing nodes 10 with which local computing devices used by cloud consumers, such as, for example, personal digital assistant (PDA), dedicated device or cellular telephone 54A, desktop computer 54B, laptop computer 54C, and/or automobile computer system 54N may communicate. Nodes 10 may communicate with one another. They may be grouped (not shown) physically or virtually, in one or more networks, such as Private, Community, Public, or Hybrid clouds as described hereinabove, or a combination thereof. This allows cloud computing environment 50 to offer infrastructure, platforms and/or software as services for which a cloud consumer does not need to maintain resources on a local computing device. It is understood that the types of computing devices 54A-N shown in FIG. 2 are intended to be illustrative only and that computing nodes 10 and cloud computing environment 50 can communicate with any type of computerized device over any type of network and/or network addressable connection (e.g., using a web browser).

Figure 3:
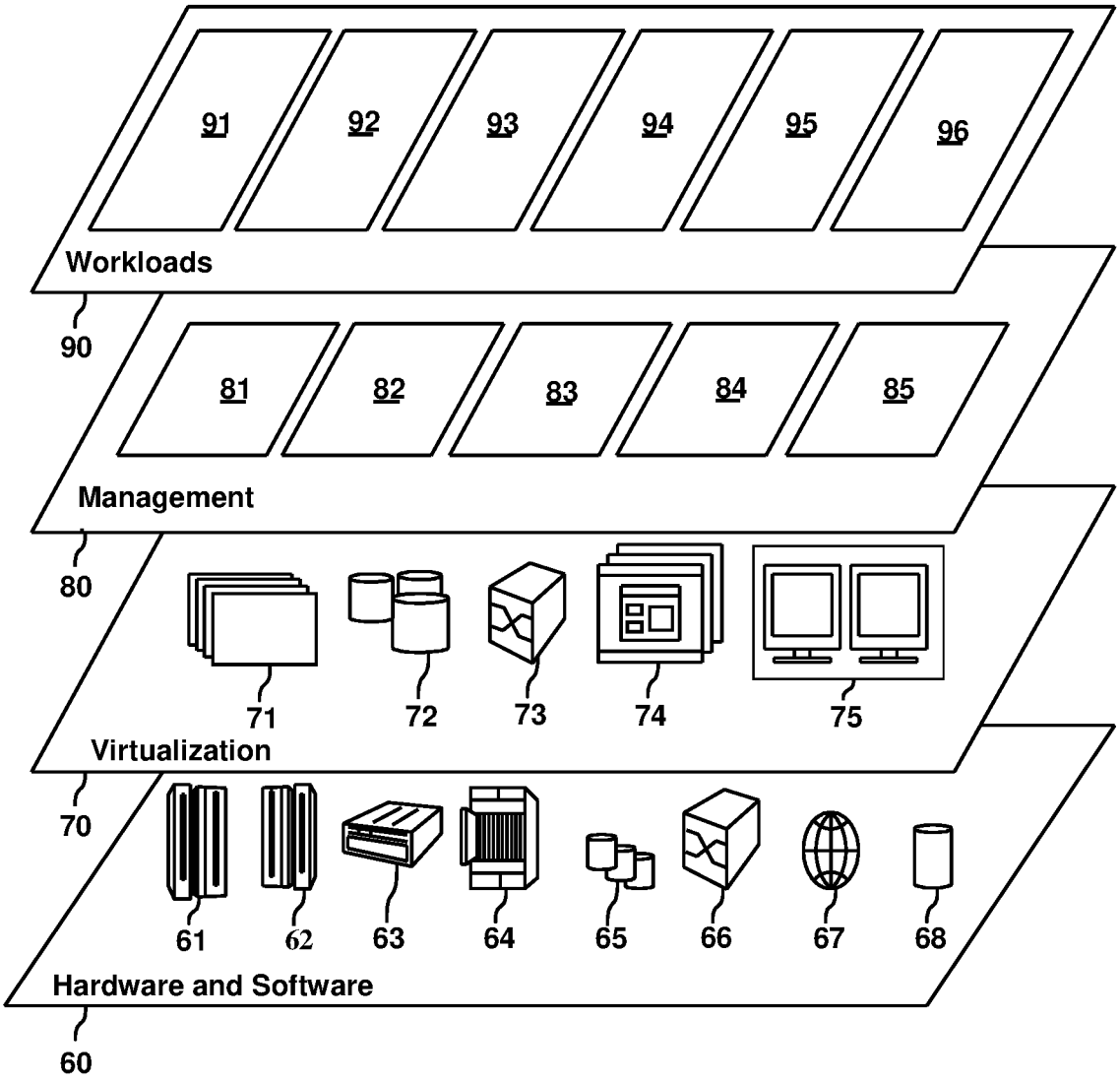
FIG. 3 depicts abstraction model layers according to an embodiment of the present invention.

Referring now to FIG. 3, a set of functional abstraction layers provided by cloud computing environment 50 (FIG. 2) is shown. It should be understood in advance that the components, layers, and functions shown in FIG. 3 are intended to be illustrative only and embodiments of the invention are not limited thereto. As depicted, the following layers and corresponding functions are provided:

Hardware and software layer 60 includes hardware and software components. Examples of hardware components include: mainframes 61; RISC (Reduced Instruction Set Computer) architecture based servers 62; servers 63; blade servers 64; storage devices 65; and networks and networking components 66. In some embodiments, software components include network application server software 67 and database software 68.

Virtualization layer 70 provides an abstraction layer from which the following examples of virtual entities may be provided: virtual servers 71; virtual storage 72; virtual networks 73, including virtual private networks; virtual applications and operating systems 74; and virtual clients 75.

In one example, management layer 80 may provide the functions described below. Resource provisioning 81 provides dynamic procurement of computing resources and other resources that are utilized to perform tasks within the cloud computing environment. Metering and Pricing 82 provide cost tracking as resources are utilized within the cloud computing environment, and billing or invoicing for consumption of these resources. In one example, these resources may include application software licenses. Security provides identity verification for cloud consumers and tasks, as well as protection for data and other resources. User portal 83 provides access to the cloud computing environment for consumers and system administrators. Service level management 84 provides cloud computing resource allocation and management such that required service levels are met. Service Level Agreement (SLA) planning and fulfillment 85 provide pre-arrangement for, and procurement of, cloud computing resources for which a future requirement is anticipated in accordance with an SLA.

Workloads layer 90 provides examples of functionality for which the cloud computing environment may be utilized. Examples of workloads and functions which may be provided from this layer include: mapping and navigation 91; software development and lifecycle management 92; virtual classroom education delivery 93; data analytics processing 94; transaction processing 95; and vehicle managing 96.

It should be noted that the processing of managing a shared vehicle or achieved by a device for managing a shared vehicle according to embodiments of this disclosure could be implemented by computer system/server 12 of FIG. 1.

As described above, the damage rate of the vehicles remains high. The damaged vehicle can cause a variety of problems. For example, the damaged vehicle can significantly reduce the user experiences and the safety in using the vehicle. Additionally, it is hard for the sharing vehicle service providers to locate the damaged vehicle, and to repair the damaged vehicle in an appropriate time, thus increasing the maintenance costs.

To detect the damaged vehicle, one traditional approach is to install various sensors on the vehicle, but the costs and power consumption of these sensors are rather high. Another traditional approach is that the user who uses or attempts to use the vehicle can report the damage of the vehicle to the sharing vehicle service providers. However, the sharing vehicle service providers cannot control the behavior of the user, for example, the user may report a false damage, or may not report the damage.

In order to at least partially solve one or more of the above problems and other potential problems, example embodiments of the present disclosure propose a solution for managing a shared vehicle. In the solution, first information about a user is obtained. The first information indicates a speed of at least one vehicle used by the user. Additionally, or alternatively, the first information may indicate other proper factors, such as a health condition, remaining life or the like of at least one vehicle used by the user.

A target vehicle is determined from the at least one vehicle based on the first information. Second information about the target vehicle is determined. The second information indicates respective speeds of the target vehicle moving at a plurality of time intervals. An abnormal state of the target vehicle is detected based on the second information. The abnormal state indicates that a malfunction occurs in the target vehicle.

As such, a potentially problematic vehicle can be automatically identified. In this way, the costs for detecting the problematic vehicle is reduced, and the accuracy and efficiency detecting the problematic vehicle is improved, thus improving the user experience of the shared vehicle service.

Figure 4:
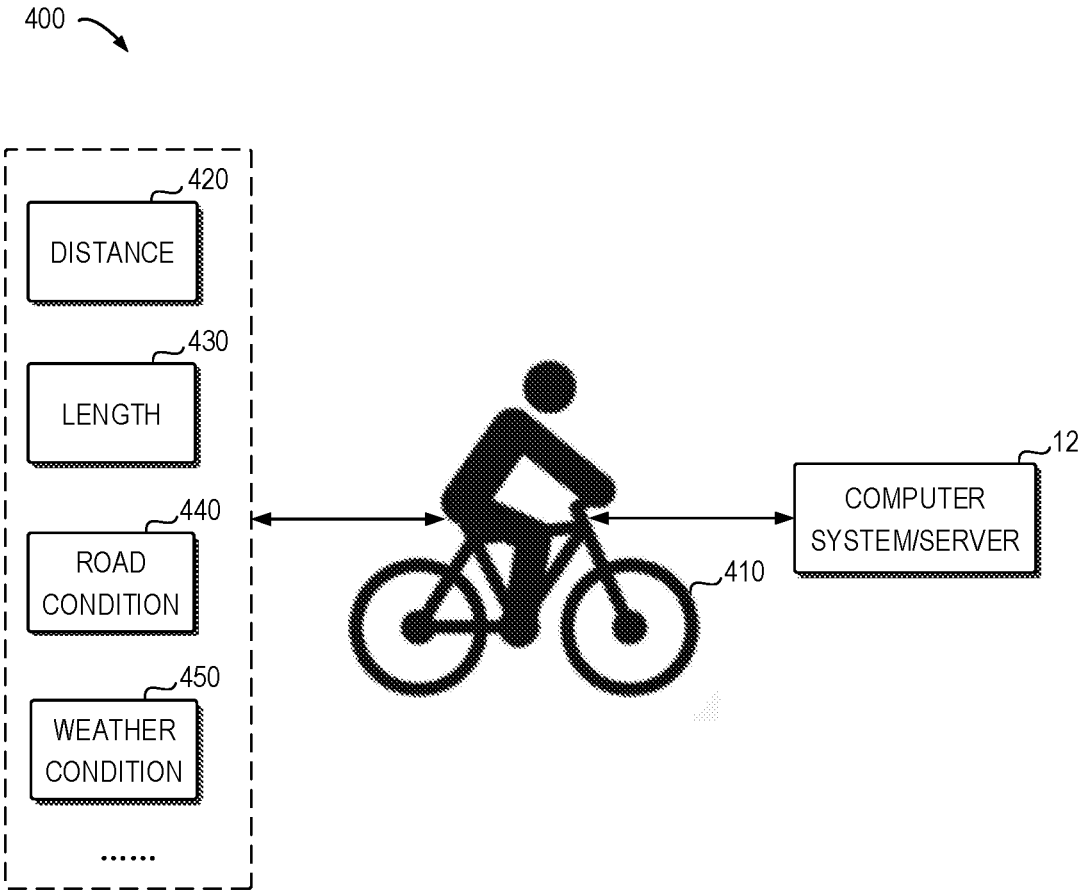
FIG. 4 depicts a schematic diagram of an example vehicle management environment according to an embodiment of the present invention.

Reference is now made to FIG. 4, which depicts a schematic diagram of an example vehicle management environment 400 according to an embodiment of the present invention. As shown in FIG. 4, a vehicle 410 participates in the vehicle management environment 400. The vehicle 410 can be any vehicle, e.g., a bicycle, a balance car, a scooter or any appropriate vehicle that can facilitate the movement of the user.

The vehicle 410 can collect information associated with use of the vehicle 410 by the user at a time interval and provide the collected information to the computer system/server 12. The information may include, but not limited to, a moving distance 420, a length of the time interval 430, a road condition 440 and a weather condition 450. For example, the information may also include a speed of the vehicle 410 used by the user. The moving distance 420 indicates the distance that the vehicle 410 used by the user moves.

The length of the time interval 430 indicates the length of the time interval when the vehicle 410 is used by the user. In some embodiments, the time interval may be the entire time when the vehicle 410 is used by the user. Additionally, or alternatively, the time interval may exclude the invalid time. The invalid time indicates the time that the vehicle 410 is not moving, for example, the time when the user using the vehicle 410 waits for the traffic light, the time when the user using the vehicle 410 stops and engages in other activities, such as making a call.

The road condition indicates the condition of the road on which the vehicle 410 used by the user moves. In some embodiments, the road condition may indicate a degree of congestion of the road, for example, a road having a serious traffic jam may have a high degree of congestion. Additionally, or alternatively, the road condition may indicate a type of road, for example, a mountain road, a waterlogged road, a muddy road, a flat road in the city or the like.

The weather condition indicates the condition of the weather when the vehicle 410 is used by the user. In some embodiments, the weather condition may indicate a type of weather, such as sunny, rainy, snowy or the like. Additionally, or alternatively, the weather condition may indicate the season, for example, the spring, summer, autumn or winter. Furthermore, the weather condition may indicate the temperature.

In some embodiments, the route that the vehicle 410 used by the user moves can be divided into a plurality of segments. For example, the route may be divided into a plurality of segments based on the time, the distance or any other appropriate manner. As a specific example, the route between two traffic lights may be defined as a segment. In this case, the moving distance 420, the length of the time interval 430, the road condition 440 and the weather condition 450 may relate to a certain segment.

The computer system/server 12 may determine first information about the user based on the information obtained from the vehicle 410. The first information indicates a speed of at least one vehicle used by the user. In some embodiments, the speed of the vehicle 410 may be determined simply based on the moving distance 420 and the length of the time interval 430. For example, the speed of the vehicle 410 may be calculated by dividing the moving distance 420 by the length of the time interval 430. Alternatively, when the vehicle 410 provides its speed to the computer system/server 12 directly, the computer system/server 12 may determine the speed of the vehicle 410 directly.

In some embodiments, the speed of the vehicle 410 may also be determined based on the other factors, such as the road condition 440 and the weather condition 450. For example, the computer system/server 12 may assign different weight to different road conditions and weather conditions and multiply the actual speed by the weight so as to determine an adjusted speed which accounts for the road condition 440 and the weather condition 450.

For example, assume that the weight for the road condition indicating a flat road in the city is 1, and the actual speed is 15 km/h, in this case, the adjusted speed is 1*15=15 km/h. In contrast, assume that the weight for the road condition indicating a mountain road is set to 1.3, and the actual speed is 11 km/h, the adjusted speed is 1.3*11=14.3 km/h. As such, the effects caused by the other factors can be eliminated in detecting the abnormal state of the vehicle 410.

Movement of the vehicle can be monitored using one or more methods. For example, the user's cellular phone can be employed, the vehicle can have a sensor(s), transmitters, GPS signaling or other mechanisms to monitor the speed, position, etc.

Figure 5A:
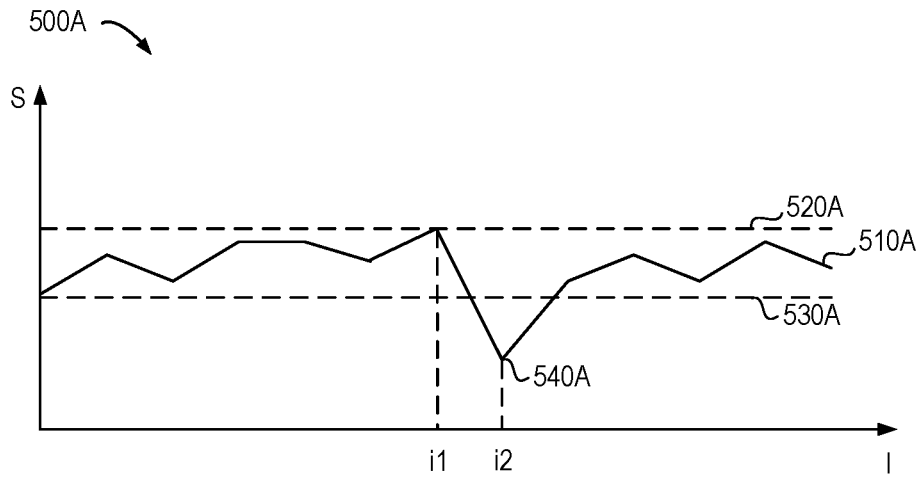
FIG. 5A depicts a schematic diagram of example first information about a user according to an embodiment of the present invention.

FIG. 5A depicts a schematic diagram 500A of example first information 510A about a user (referred to as user A) according to an embodiment of the present invention. The horizontal axis represents the time interval, and the vertical axis represents the speed of the vehicle 410. As shown in FIG. 5A, a point, such as the point 540A, in the first information 510A indicates a speed of a vehicle 410 used by the user A at a time interval. It is to be understood that, the user A may use different vehicles at different time intervals, in this case, the points may indicate the speeds of the same vehicle or different vehicles.

For example, at the time interval i1, the user A may use a first vehicle, in this case, the point indicates the speed of the first vehicle used by the user A at the time interval i1. At the time interval i2, the user A may use a second vehicle, in this case, the point indicates the speed of the second vehicle used by the user A at the time interval i2.

Figure 5B:
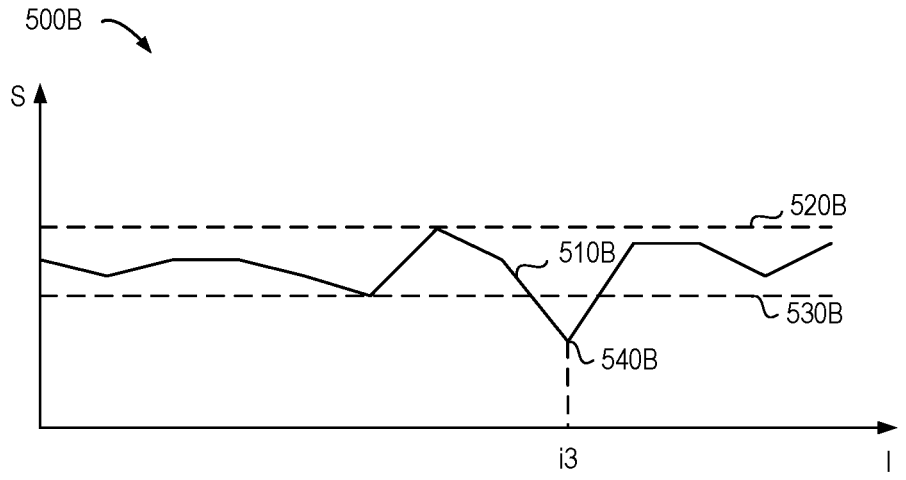
FIG. 5B depicts a schematic diagram of another example first information about another user according to an embodiment of the present invention.

Similarly, FIG. 5B depicts a schematic diagram 500B of example first information 510B about another user (referred to as user B) according to an embodiment of the present invention. Like FIG. 5A, the horizontal axis in FIG. 5B represents the time interval, and the vertical axis in FIG. 5B represents the speed of the vehicle 410. A point in the first information 510B indicates a speed of a vehicle 410 used by the user B at a time interval. Also, the points may indicate the speeds of the same vehicle or different vehicles.

Figure 5C:
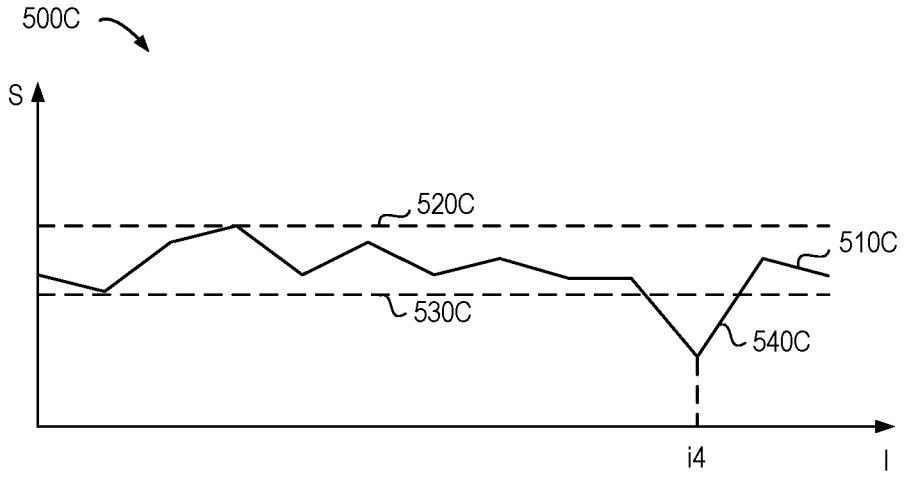
FIG. 5C depicts a schematic diagram of yet another example first information about yet another user according to an embodiment of the present invention.

Additionally, FIG. 5C depicts a schematic diagram 500C of example first information 510C about yet another user (referred to as user C) according to an embodiment of the present invention. Like FIGS. 5A and 5B, the horizontal axis in FIG. 5C represents the time interval, and the vertical axis in FIG. 5C represents the speed of the vehicle 410. A point in the first information 510C indicates a speed of a vehicle 410 used by the user C at a time interval. Also, the points may indicate the speeds of the same vehicle or different vehicles. Hereinafter, the first information 510A-510C may be collectively referred to the first information 510.

The computer system/server 12 may determine a target vehicle from the at least one vehicle based on the first information 510. Normally, a user has a rather fixed speed in using a vehicle 410. In this case, in some embodiments, the computer system/server 12 may determine a user reference speed range. When a speed of a vehicle 410 exceeds or otherwise falls out of the user reference speed range, such vehicle 410 may be determined as the target vehicle.

For example, the computer system/server 12 may determine a user reference speed based on historical speeds of vehicles used by the user. The user reference speed may be the average value of the historical speeds of vehicles. Then, the computer system/server 12 may determine the user reference speed range based on the user reference speed and a predetermined value. For example, the predetermined value may be a variance of the historical speeds of vehicles. In this case, the upper limit of the user reference speed range may be calculated by adding the user reference speed and the variance, while the lower limit of the user reference speed range may be calculated by subtracting the variance from the user reference speed. Alternatively, the user reference speed and the variance can be set to be any appropriate value or predetermined by the service provider or the user.

Then, the computer system/server 12 may determine the target vehicle based on the user reference speed range. For example, if a speed of a vehicle 410 exceeds or falls out of the user reference speed range, in other words, if the difference between the user reference speed and a speed of a vehicle 410 exceeds a predetermined threshold difference, which can be for example the variance, the vehicle 410 may be determined as the target vehicle.

As shown in FIG. 5A, the upper limit of the user reference speed range is indicated by the dashed line 520A, and the lower limit of the user reference speed range is indicated by the dashed line 530A. Since the speed indicated by the point 540A exceeds the user reference speed range, the vehicle 410 corresponding to the point 540A is determined to be the target vehicle.

Similarly, in FIG. 5B, the upper limit of the user reference speed range is indicated by the dashed line 520B, and the lower limit of the user reference speed range is indicated by the dashed line 530B. Since the speed at the time interval i3 indicated by the point 540B exceeds the user reference speed range, the vehicle 410 corresponding to the point 540B is determined to be the target vehicle.

Additionally, in FIG. 5C, the upper limit of the user reference speed range is indicated by the dashed line 520C, and the lower limit of the user reference speed range is indicated by the dashed line 530C. Since the speed at the time interval i4 indicated by the point 540C exceeds the user reference speed range, the vehicle 410 corresponding to the point 540C is determined to be the target vehicle. For the sake of description, in the following text, it is assumed that the target vehicle corresponds to the points 540A-540C is the same vehicle.

Returning to FIG. 4, the computer system/server 12 may determine second information about the target vehicle. The second information indicates respective speeds of the target vehicle moving at a plurality of time intervals. Similar to the first information 510, the computer system/server 12 may determine the second information based on the information (also referred to as movement information) collected at the target vehicle and provided to the computer system/server 12.

In some embodiments, the speed of the vehicle 410 may be determined simply based on the moving distance 420 and the length of the time interval 430. For example, the speed of the vehicle 410 may be calculated by dividing the moving distance 420 by the length of the time interval 430. Alternatively, when the vehicle 410 provides its speed to the computer system/server 12 directly, the computer system/server 12 may determine the speed of the vehicle 410 directly.

In some embodiments, the speed of the vehicle 410 may also be determined based on the other factors, such as the road condition 440 and the weather condition 450. For example, the computer system/server 12 may assign different weight to different road conditions and weather conditions, and multiply the actual speed by the weight so as to determine an adjusted speed which accounts for the road condition 440 and the weather condition 450.

Figure 6:
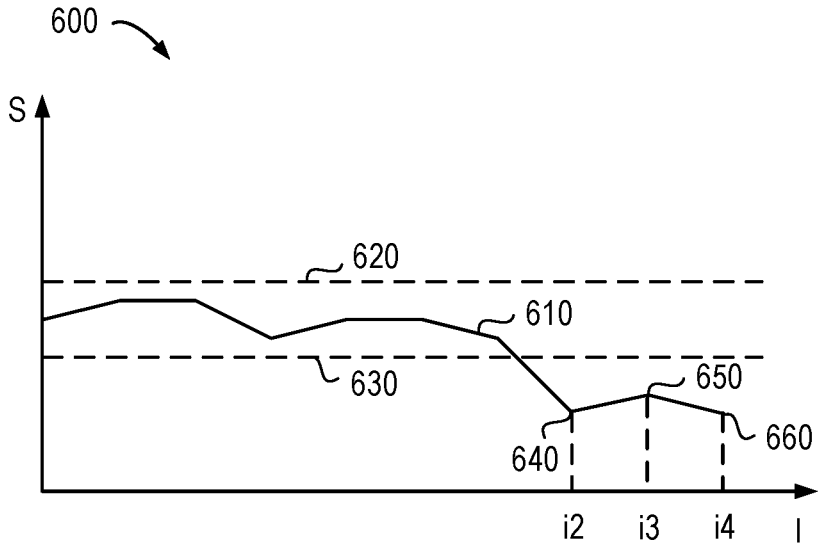
FIG. 6 depicts a schematic diagram of example second information about a vehicle according to an embodiment of the present invention.

FIG. 6 depicts a schematic diagram 600 of example second information 610 about a target vehicle according to an embodiment of the present invention. As shown in FIG. 6, a point in the second information 610 indicates a speed of the target vehicle used by a user at a time interval. It is to be understood that, the target vehicle may be used by different users at different time intervals. In this case, the points may indicate the speeds of the target vehicle used by the same user or different users.

For example, at the time interval i2, the target vehicle may be used by the user A as shown in FIG. 5A, in this case, the point 640 indicates the speed of the target vehicle used by the user A at the time interval i2. At the time interval i3, the target vehicle may be used by the user B as shown in FIG. 5B, in this case, the point 650 indicates the speed of the target vehicle used by the user B at the time interval i3. Additionally, at the time interval i4, the target vehicle may be used by the user C as shown in FIG. 5C, in this case, the point 660 indicates the speed of the target vehicle used by the user C at the time interval i4.

Then, the computer system/server 12 may detect an abnormal state of the target vehicle based on the second information 610. The abnormal state indicates that a malfunction occurs in the target vehicle. Normally, a vehicle 410 has a rather fixed speed. In this case, in some embodiments, the computer system/server 12 may determine a normal speed range. If the speeds of the target vehicle continuously exceed the normal speed range, it may be determined that a malfunction occurs in the target vehicle.

As such, it is possible to reduce the probability that a vehicle 410 is determined to be malfunctioning because of a speed of the vehicle 410 used by a user accidentally exceeds the user reference speed, and thus improving the accuracy of the vehicle malfunction detection.

For example, the computer system/server 12 may determine a vehicle reference speed based on historical speeds of the target vehicle. The vehicle reference speed may be the average value of the historical speeds of the target vehicle moving at a plurality of time intervals. Additionally, the computer system/server 12 may determine a variance of the historical speeds of the target vehicle. In this case, the normal speed range may be determined based on the vehicle reference speed and the variance. For example, the upper limit of the normal speed range may be calculated by adding the vehicle reference speed and the variance, while the lower limit of the vehicle speed range may be calculated by subtracting the variance from the vehicle reference speed.

Alternatively, the vehicle reference speed can be set to be any appropriate value or predetermined by the service provider. For example, since it can be assumed that a new vehicle does not have any malfunction, the vehicle reference speed may be set to be the speed of the new vehicle. In addition, the variance can also be set to be any appropriate value or predetermined by the service provider, for example, the variance of the speeds of a predetermined number of new vehicles. As shown in FIG. 6, the upper limit of the normal speed range is indicated by the dashed line 620, and the lower limit of the normal speed range is indicated by the dashed line 630.

In some embodiments, the computer system/server 12 may determine a pattern of the respective speeds of the target vehicle moving at the plurality of time intervals exceed the normal speed range, and detect the abnormal state based on the pattern. For example, as shown in FIG. 6, the speeds at the time intervals i2-i4 indicated by the points 640-660 may form a pattern. Since these speeds exceed the normal speed range, the computer system/server 12 may determine that abnormal state exists.

For example, since the speeds of the target vehicle at a plurality of time intervals after the time interval indicated by the point 640 exceed the normal speed range, the target vehicle corresponding to the point 540 is determined to be the target vehicle. It is to be understood that, the point 540 as shown in FIG. 5 may correspond to the point 640. That is to say, the point 540 and the point 640 are at the same time interval. Alternatively, the point 540 may correspond to other points at other time intervals after the time interval indicated by the point 640.

Alternatively or additionally, since the speeds of the vehicles 410 on the same route at the same time are more or less the same, the computer system/server 12 may also compare the speed of the target vehicle to the speeds of the other vehicles moving on the same route at the same time interval.

For example, the target vehicle may always be used at the peak hour with a heavily traffic congestion, and the speed of the target vehicle may continuously exceed the normal speed range. The computer system/server 12 may determine a route reference speed which may be, for example, the average value of the speeds of all the vehicles moving on the same route at the same time interval. Then, the computer system/server 12 may determine whether a difference between the speed of the target vehicle and the route reference speed exceeds a predetermined threshold. If the difference exceeds the predetermined threshold, the target vehicle may be determined to be malfunctioning. In this way, the accuracy of detecting a malfunctioning vehicle can be further increased.

As such, an abnormal state of a vehicle can be automatically detected. In this way, it is possible to reduce the costs for detecting whether a malfunction occurs in the vehicle, and improve the accuracy and efficiency in determining the problematic vehicle.

Figure 7:
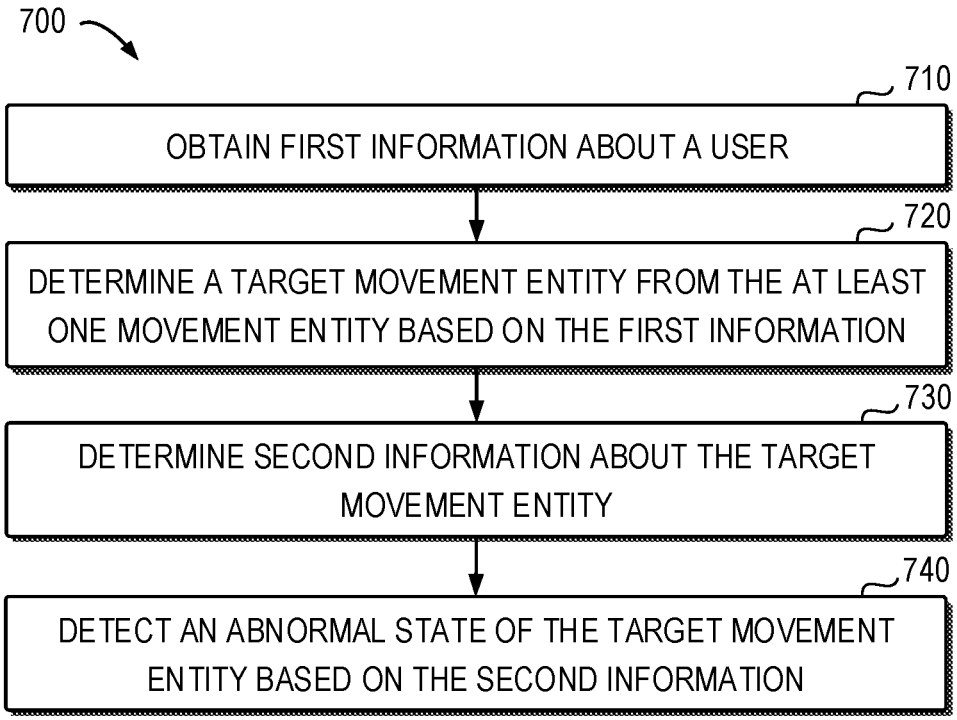
FIG. 7 depicts a flow chart of an example method of managing a vehicle according to an embodiment of the present invention.

FIG. 7 depicts a flow chart of an example method 700 of managing a vehicle 410 according to an embodiment of the present invention. The method 700 may be at least in part implemented by the computer system/server 12, or other suitable systems.

At 710, the computer system/server 12 obtains first information 510 about a user. The first information 510 indicates a speed of at least one vehicle used by the user. In some embodiments, the computer system/server 12 may obtain information associated with use of the at least one vehicle by the user at a time interval. The information includes, for example, but not limited to, a moving distance 420 indicating the distance moved in the time interval, a length 430 of the time interval, a road condition 440 in the time interval, a weather condition 450 in the time interval, and/or the like. Then, the computer system/server 12 may determine the first information 510 based on the obtained information.

At 720, the computer system/server 12 determines a target vehicle from the at least one vehicle based on the first information 510. In some embodiments, the computer system/server 12 may determine a user reference speed based on historical speeds of vehicles 410 used by the user. For example, the user reference speed may be determined based on an average of the respective speeds of the vehicles used by the user at the plurality of time intervals.

Then, the computer system/server 12 may determine a difference between the user reference speed and a speed of a candidate vehicle. The candidate vehicle is selected from the at least one vehicle used by the user. When the difference exceeds a threshold difference, the computer system/server 12 may determine the candidate vehicle as the target vehicle.

At 730, the computer system/server 12 determines second information 610 about the target vehicle. The second information 610 indicates respective speeds of the target vehicle moving at a plurality of time intervals. In some embodiments, the computer system/server 12 may obtain information associated with moving of the target vehicle at the plurality of time intervals. The information includes, for example, but not limited to, a moving distance of each of the plurality of time intervals 420, a length of each of the plurality of time intervals 430, a road condition of each of the plurality of time intervals 440 and a weather condition of each of the plurality of time intervals 450. Then, the computer system/server 12 may determine the second information 610 based on the obtained information.

At 740, the computer system/server 12 detects an abnormal state of the target vehicle based on the second information 610. The abnormal state indicates that a malfunction occurs in the target vehicle. In some embodiments, the computer system/server 12 may determine a pattern of differences between the respective speeds of the target vehicle moving at the plurality of time intervals and a vehicle reference speed. For example, the computer system/server 12 may determine the vehicle reference speed based on an average of the respective speeds of the target vehicle moving at the plurality of time intervals. Alternatively, the computer system/server 12 may determine the vehicle reference speed based on the speed of the new vehicle. Then, the computer system/server 12 may detect the abnormal state based on the pattern.

For example, the computer system/server 12 may determine, based on the pattern, whether a speed of the target vehicle during a predetermined time period is out of a normal speed range. In some embodiments, the predetermined time period may include the time interval at which the difference between the user reference speed and the speed of the target vehicle exceeds the threshold difference. For example, the predetermined time period may surround that time interval.

Then, when the speed of the target vehicle is determined to be out of the normal speed range, the computer system/server 12 may determine that that a malfunction occurs in the target vehicle.

As such, a potentially problematic vehicle can be automatically identified. In this way, the costs for detecting the problematic vehicle are reduced, and the accuracy and efficiency detecting the problematic vehicle is improved, thus improving the user experience of the sharing vehicle.

Figure 8:
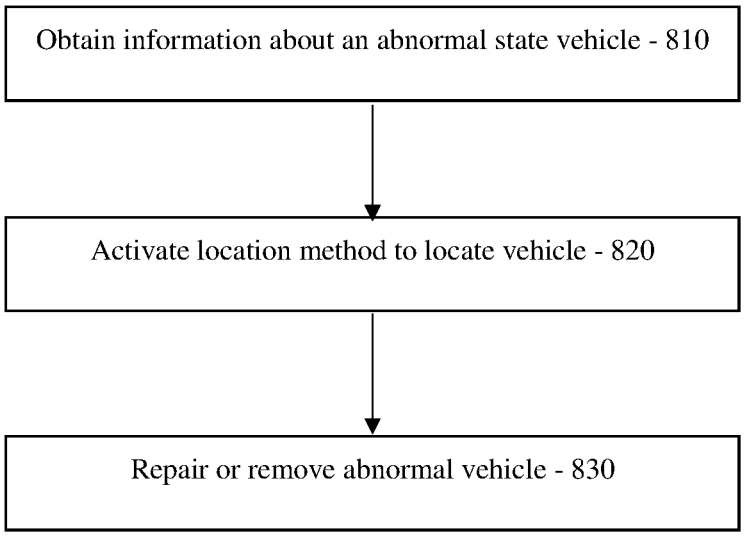
FIG. 8 depicts a flow chart of an example method for managing/mainlining vehicles according to an embodiment of the present invention.

FIG. 8 depicts a flow chart of an example method 800 of managing/maintaining vehicles according to an embodiment of the present invention. The method 800 may be at least in part implemented by the computer system/server 12 and can include one or more dedicated devices for locating vehicles in need of repair. Computer system/server 12 may include the dedicated portable electronic device (e.g., device 54A in FIG. 2) that can be employed while a maintenance worker is in the field. Using sensors or global positioning systems mounted on the vehicles, the vehicles can be monitored, and once a determination is made that a vehicle is acting abnormally, the vehicles can be located and removed from service by employing the portable device 54A). In one embodiment, the device 54A can determine the abnormal state and generate an alert for a particular vehicle. Then, the vehicle can be located using global positioning or a homing signal using the portable device 54A to identify where the vehicle is while in the field.

At 810, the computer system/server 12 obtains information about a target vehicle identified with an abnormal state.

At 820, the computer system/server 12 activates a method to locate the vehicle, e.g., employs global positioning, a homing signal, video or other methods from the vehicle or other sources to identify a current location of the vehicle.

At 830, the abnormal state indicates that a malfunction occurs in the target vehicle so once the vehicle is located, the target vehicle is repaired or removed from service. As such, a potentially problematic vehicle can be identified and fixed. In this way, the user experience of the sharing vehicle is enhanced.

The present invention may be a system, a method, and/or a computer program product at any possible technical detail level of integration. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A method of managing a shared vehicle, comprising:

obtaining, by one or more processing units, first information about a user, the first information indicating a speed of at least one shared vehicle used by the user;

determining, by the one or more processing units, a target vehicle from the at least one shared vehicle based on the first information;

determining, by the one or more processing units, second information about the target vehicle, the second information indicating respective speeds of the target vehicle over multiple travel segments at a plurality of time intervals;

determining, by the one or more processing units, a pattern of the second information between the plurality of time intervals; and detecting, by the one or more processing units, an abnormal state of the target vehicle based on the pattern of the second information, the abnormal state indicating that a malfunction occurs in the target vehicle.

2. The method of claim 1, wherein the obtaining of the first information further comprises:

obtaining, by the one or more processing units, third information associated with use of the at least one shared vehicle by the user at a time interval, the third information including at least one of: a moving distance, a length of the time interval, a road condition and a weather condition; and determining, by the one or more processing units, the first information based on the obtained third information.

3. The method of claim 1, wherein the determining of the target vehicle further comprises:

determining, by the one or more processing units, a user reference speed based on historical speeds of vehicles used by the user; and determining, by the one or more processing units, a difference between the user reference speed and a speed of a candidate vehicle, the candidate vehicle being selected from the at least one shared vehicle used by the user; and in response to the difference exceeding a threshold difference, determining, by the one or more processing units, the candidate vehicle as the target vehicle.

4. The method of claim 1, wherein the determining of the second information further comprises:

obtaining, by the one or more processing units, respective movement information associated with the target vehicle at the plurality of time intervals, the movement information including at least one of: a moving distance, a length of each of the plurality of time intervals, a road condition and a weather condition; and determining, by the one or more processing units, the second information based on the obtained movement information.

5. The method of claim 1, wherein the detecting of the abnormal state further comprises:

determining, by the one or more processing units, based on the pattern, whether a speed of the target vehicle during a predetermined time period is out of a normal speed range; and in response to determining that the speed of the target vehicle is out of the normal speed range, determining, by the one or more processing units, that a malfunction occurs in the target vehicle.

6. The method of claim 1, further comprising:

determining, by the one or more processing units, a vehicle reference speed based on an average of the respective speeds of the target vehicle moving at the plurality of time intervals.

7. A device for managing a shared vehicle, comprising:

a processing unit; and a non-transitory memory coupled to the processing unit and storing instructions thereon, the instructions, when executed by the processing unit, causing the processing unit to perform acts including:

obtaining first information about a user, the first information indicating a speed of at least one shared vehicle used by the user;

determining a target vehicle from the at least one shared vehicle based on the first information;

determining second information about the target vehicle, the second information indicating respective speeds of the target vehicle over multiple travel segments moving at a plurality of time intervals;

determining a pattern of the second information between the plurality of time intervals; and detecting an abnormal state of the target vehicle based on the pattern of the second information, the abnormal state indicating that a malfunction occurs in the target vehicle.

8. The device of claim 7, wherein the obtaining of the first information further comprises:

obtaining third information associated with use of the at least one shared vehicle by the user at a time interval, the third information including at least one of: a moving distance, a length of the time interval, a road condition and a weather condition; and determining the first information based on the obtained third information.

9. The device of claim 7, wherein the determining of the target vehicle further comprises:

determining a user reference speed based on historical speeds of vehicles used by the user; and determining a difference between the user reference speed and a speed of a candidate vehicle, the candidate vehicle being selected from the at least one shared vehicle used by the user; and in response to the difference exceeding a threshold difference, determining the candidate vehicle as the target vehicle.

10. The device of claim 7, wherein the determining of the second information further comprises:

obtaining respective movement information associated with the target vehicle at the plurality of time intervals, the movement information including at least one of: a moving distance, a length of each of the plurality of time intervals, a road condition and a weather condition; and determining the second information based on the obtained movement information.

11. The device of claim 7, wherein the detecting of the abnormal state, further comprises:

determining, based on the pattern, whether a speed of the target vehicle during a predetermined time period is out of a normal speed range; and in response to determining that the speed of the target vehicle is out of the normal speed range, determining that that a malfunction occurs in the target vehicle.

12. The device of claim 7, further comprising:

determining a vehicle reference speed based on an average of the respective speeds of the target vehicle moving at the plurality of time intervals.

13. A computer program product being tangibly stored on a non-transient machine-readable medium and comprising machine-executable instructions, the instructions, when executed on a device, causing the device to perform acts including:

obtaining first information about a user, the first information indicating a speed of at least one shared vehicle used by the user;

determining a target vehicle from the at least one shared vehicle based on the first information;

determining second information about the target vehicle, the second information indicating respective speeds of the target vehicle over multiple travel segments moving at a plurality of time intervals;

determining a pattern of the second information between the plurality of time intervals; and detecting an abnormal state of the target vehicle based on the pattern of the second information, the abnormal state indicating that a malfunction occurs in the target vehicle.

14. The device of claim 13, wherein the obtaining of the first information further comprises:

obtaining third information associated with use of the at least one shared vehicle by the user at a time interval, the third information including at least one of: a moving distance, a length of the time interval, a road condition and a weather condition; and determining the first information based on the obtained third information.

15. The device of claim 13, wherein the determining of the target vehicle, further comprises:

determining a user reference speed based on historical speeds of vehicles used by the user;

determining a difference between the user reference speed and a speed of a candidate vehicle, the candidate vehicle being selected from the at least one shared vehicle used by the user; and in response to the difference exceeding a threshold difference, determining the candidate vehicle as the target vehicle.

16. The device of claim 13, wherein the determining of the second information, further comprises:

obtaining respective movement information associated with the target vehicle at the plurality of time intervals, the movement information including at least one of: a moving distance, a length of each of the plurality of time intervals, a road condition and a weather condition; and determining the second information based on the obtained movement information.

17. The device of claim 13, wherein the detecting of the abnormal state, further comprises:

determining, based on the pattern, whether a speed of the target vehicle during a predetermined time period is out of a normal speed range; and in response to determining that the speed of the target vehicle is out of the normal speed range, determining that that a malfunction occurs in the target vehicle.

* * * * *